US008622645B2

(12) United States Patent
Hill

(10) Patent No.: US 8,622,645 B2
(45) Date of Patent: Jan. 7, 2014

(54) COUPLER WITH GRAVITY OPERATED SAFETY DEVICE

(76) Inventor: Ian Hill, Newry (GB)

( * ) Notice: Subject to any disclaimer, the term of this patent is extended or adjusted under 35 U.S.C. 154(b) by 278 days.

(21) Appl. No.: 12/555,476

(22) Filed: Sep. 8, 2009

(65) Prior Publication Data

US 2010/0061799 A1 Mar. 11, 2010

(30) Foreign Application Priority Data

Sep. 8, 2008 (GB) ..... 0816335.4

(51) Int. Cl.
*E02F 3/96* (2006.01)

(52) U.S. Cl.
USPC ..... 403/322.1; 37/468; 172/272

(58) Field of Classification Search
USPC ..... 403/321, 322.1, 322.3; 37/468, 903; 172/272; 414/723
See application file for complete search history.

(56) References Cited

U.S. PATENT DOCUMENTS

| | | | | |
|---|---|---|---|---|
| 1,085,964 | A | 2/1914 | Briggs | |
| 2,056,006 | A | 9/1936 | Hodgkins | |
| 2,932,282 | A | 1/1945 | McKinley et al. | |
| 2,366,587 | A | 4/1960 | Armington | |
| 3,940,931 | A | 3/1976 | Renfro et al. | |
| 4,577,885 | A | 3/1986 | Breu | |
| 5,423,625 | A | 6/1995 | Gebauer et al. | |
| 5,748,077 | A | 5/1998 | Brandt | |
| 6,132,131 | A * | 10/2000 | Nakamura et al. | 403/322.1 |
| 6,273,128 | B1 | 8/2001 | Paczonay | |
| 6,286,412 | B1 | 9/2001 | Manring et al. | |
| 6,332,747 | B1 * | 12/2001 | Lee | 414/723 |
| 6,379,075 | B1 | 4/2002 | Shamblin et al. | |
| 6,422,805 | B1 | 7/2002 | Miller | |
| 6,481,124 | B1 | 11/2002 | Miller et al. | |
| 6,902,346 | B2 * | 6/2005 | Steig et al. | 403/322.3 |
| 7,047,866 | B2 | 5/2006 | Fatemi et al. | |
| 7,306,395 | B2 * | 12/2007 | Fatemi | 403/321 |
| 7,426,796 | B2 | 9/2008 | Cunningham et al. | |
| 7,493,712 | B2 | 2/2009 | McCormick et al. | |

(Continued)

FOREIGN PATENT DOCUMENTS

| | | |
|---|---|---|
| FR | 978531 | 4/1951 |
| FR | 1146273 | 11/1957 |

(Continued)

OTHER PUBLICATIONS

European Search Report completed Nov. 20, 2009, from corresponding European Application No. EP 09 01 1452.

*Primary Examiner* — Michael P Ferguson
(74) *Attorney, Agent, or Firm* — Gardner, Linn, Burkhart & Flory, LLP

(57) ABSTRACT

A coupler for an excavator, the coupler having a body with first and second spaced-apart recesses for receiving respective pins of an excavator attachment. A first latching hook is movable into and out of a latching state in which it is capable of retaining a respective attachment pin in the first recess. A second latching hook is movable into and out of a latching state in which it is capable of retaining a respective attachment pin in the second recess. A blocking member may be provided that is movable into and out of a blocking state in which it lies in the path of the second latching member to prevent the second latching member from leaving its latching state. The blocking member may be movable into and out of the blocking state under the influence of gravity.

25 Claims, 9 Drawing Sheets

(56) References Cited

U.S. PATENT DOCUMENTS

| | | | | |
|---|---|---|---|---|
| 7,549,243 | B1 | 6/2009 | Gilles | |
| 7,648,305 | B2 * | 1/2010 | Beales | 403/322.1 |
| 7,797,862 | B2 * | 9/2010 | Daraie et al. | 414/723 |
| 7,984,575 | B2 * | 7/2011 | Robl et al. | 37/468 |
| 7,984,576 | B2 | 7/2011 | Miller et al. | |
| 2002/0071754 | A1 | 6/2002 | Fatemi | |
| 2004/0255774 | A1 | 12/2004 | Hill | |
| 2005/0169703 | A1 | 8/2005 | Fatemi | |
| 2005/0214105 | A1 | 9/2005 | Steig, Jr. et al. | |
| 2007/0157492 | A1 | 7/2007 | Miller et al. | |
| 2007/0166143 | A1 | 7/2007 | Hart et al. | |
| 2007/0199214 | A1 | 8/2007 | McCormick et al. | |
| 2009/0282712 | A1 * | 11/2009 | Pruszynski | 37/468 |
| 2010/0067982 | A1 | 3/2010 | Hill | |
| 2011/0088795 | A1 | 4/2011 | Hill | |
| 2011/0091267 | A1 | 4/2011 | Hill | |
| 2011/0243654 | A1 | 10/2011 | Hill | |

FOREIGN PATENT DOCUMENTS

| | | | | |
|---|---|---|---|---|
| FR | 2 914 932 | A1 | 10/2008 | |
| GB | 897384 | | 5/1962 | |
| GB | 1586621 | | 3/1981 | |
| GB | 2 330 570 | A | 4/1999 | |
| GB | 2332417 | A | 6/1999 | |
| GB | 2 450 127 | A | 12/2008 | |
| JP | 57155168 | A | 9/1982 | |
| KR | 2001 0019689 | A | 3/2001 | |
| NZ | 220 557 | A | 2/1991 | |
| WO | WO 98/40569 | A1 | 9/1998 | |
| WO | WO 2005/026454 | A1 | 3/2005 | |
| WO | WO 2008/031590 | A2 | 3/2008 | |
| WO | WO 2011/035883 | A1 | 3/2011 | |
| WO | WO 2008/029112 | * | 3/2013 | E02F 3/36 |

* cited by examiner

COUPLER WITH GRAVITY OPERATED SAFETY DEVICE

FIELD OF THE INVENTION

The present invention relates to a coupler for excavators. The invention relates particularly to couplers having power-operated latching hooks.

BACKGROUND TO THE INVENTION

It is well known for a coupler to have a hydraulically operated latching hook for engaging with the pins of an attachment, e.g., a bucket, for the arm of an excavator. Such couplers typically include a safety mechanism for preventing the attachment from becoming disengaged from the coupler in the event of hydraulic failure.

SUMMARY OF THE INVENTION

The present invention provides an alternative, improved safety mechanism for preventing an attachment to an excavator from becoming disengaged from the coupler in the event of hydraulic failure.

Accordingly, a first aspect of the invention provides a coupler for an excavator, the coupler comprising a body having first and second spaced-apart recesses for receiving respective pins of an excavator attachment; a first latching member movable into and out of a latching state in which it is capable of retaining the respective attachment pin in the first recess; means for actuating the first latching member into and out of the latching state, a second latching member movable into and out of a latching state in which it is capable of retaining a respective attachment pin in the second recess; and means for actuating the second latching member into and out of the latching state, wherein the coupler further comprises a blocking member movable into and out of a blocking state in which it lies in the path of the second latching member to prevent the second latching member from leaving its latching state, and wherein the blocking member is movable into and out of the blocking state under the influence of gravity.

The blocking member may be movable into and out of its blocking state upon pivoting of the coupler between a working orientation and a non-working orientation.

The blocking member, which may take the form of a bar, is pivotably mounted on the body. In one arrangement, the blocking member hangs substantially vertically from a pivot point under the influence of gravity, the pivot point being located substantially above the second recess when the coupler is in a normal working orientation. Further, the arrangement may be such that a gap is defined between the blocking member and the second latching member when the second latching member is in its latching state and when the blocking member is in its blocking state.

The first and second actuating means may be inter-linked such that the operation of one of said first and second actuating means between the latching and non-latching states causes operation of the other of the first and second actuating means between the latching and non-latching states. The first and second actuating means may be operable by a single activation of a common control device.

The first and second actuating means may comprise at least one respective hydraulic actuator controlled by a common hydraulic circuit. Each actuator may share a common hydraulic fluid feed line and a common hydraulic fluid return line. At least one of, and preferably both of, the first and second actuators may have a pilot non-return valve at the extend side port, the pilot control line being connected to the respective retract side port.

A second aspect of the invention provides a coupler for an excavator, the coupler comprising a body having first and second spaced-apart recesses for receiving respective pins of an excavator attachment; a first latching member movable into and out of a latching state in which it is capable of retaining the respective attachment pin in the first recess; means for actuating the first latching member into and out of the latching state, a second latching member movable into and out of a latching state in which it is capable of retaining a respective attachment pin in the second recess; and means for actuating the second latching member into and out of the latching state, wherein the first and second actuating means are inter-linked such that the operation of one of said first and second actuating means between the latching and non-latching states causes operation of the other of the first and second actuating means between the latching and non-latching states.

A third aspect of the invention provides a coupler comprising a body having first and second spaced-apart recesses for receiving respective pins of an excavator attachment; a first latching member movable into and out of a latching state in which it is capable of retaining the respective attachment pin in the first recess; means for actuating the first latching member into and out of the latching state, a second latching member movable into and out of a latching state in which it is capable of retaining a respective attachment pin in the second recess; and means for actuating the second latching member into and out of the latching state, wherein the first recess is shaped and dimensioned to receive attachment pins in different locations corresponding to different attachment pin spacings, the first recess further including a lip at one side of its mouth, and wherein when the first latching member adopts a latching position corresponding to the smallest attachment pin spacing accommodated by the coupler, a gap is defined between the first latching member and said lip, and wherein the arrangement is such that the gap has a size that is less than the width of the respective attachment pin.

Further advantageous aspects of the invention will become apparent to those ordinarily skilled in the art upon review of the following description of a specific embodiment and with reference to the accompanying drawings.

BRIEF DESCRIPTION OF THE DRAWINGS

An embodiment of the invention is now described by way of example and with reference to the accompanying drawings in which.

DESCRIPTION OF THE PREFERRED EMBODIMENT

Figure 1:
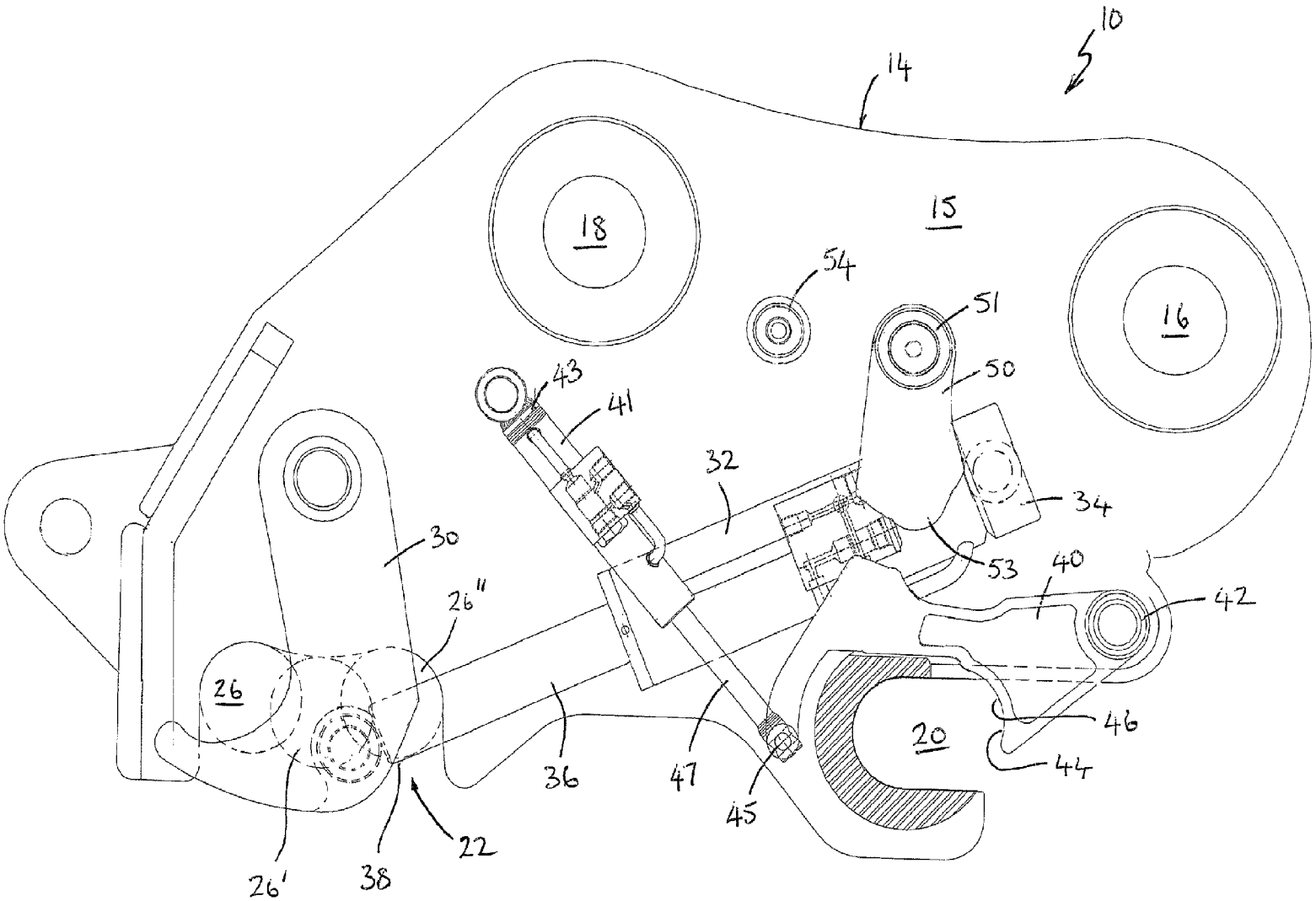
FIG. 1 is a side elevation of a coupler embodying the present invention, shown in a latched state and in a use orientation.

Referring now to the drawings and the illustrated embodiments therein, there is shown, generally indicated as 10, a coupler, or hitch, for connecting a tool, or other attachment, such as a bucket, to a jib arm (not shown) of an excavator (not shown), or other apparatus. The coupler 10 has a body 14 typically comprising two spaced-apart side plates 15 (only one visible in FIGS. 1 to 3). The body 14 is shaped to define pin-receiving apertures 16, 18 by which the coupler 10 may be connected to the end of the jib arm. Typically, there are two spaced-apart apertures 16, 18 in each of the two side plates 15, the apertures in one side plate being aligned with the apertures in the other. When connected, the coupler 10 is able to pivot with respect to the arm about the axis of the apertures 16. Usually, a hydraulic mechanism, or other power-operated mechanism (not shown), is provided, typically in association with a mechanical linkage, to pivot the coupler 10 with respect to the arm.

The body 14 includes first and second pin-receiving recesses 20, 22 formed in each side plate 15. Each recess 20, 22 is shaped and dimensioned to receive a respective pin 26 (only one shown) of a bucket or other attachment. Normally, the recesses 20, 22 face in mutually perpendicular directions. The recess 22 may be wider than is necessary to receive a single pin 26 in order to accommodate attachments with different pin spacings, as is illustrated by pins 26' and 26".

The coupler 10 also includes a power-operated latching mechanism typically comprising a latching member in the preferred form of a hook 30, and an actuator 32 typically in the form of a linear actuator, such as a hydraulic ram. Other forms of powered actuators could be used (e.g., pneumatic or electrically operated), but hydraulic is convenient because excavators typically have a hydraulic system available at or near the end of the jib arm. The latching hook 30 and ram 32 are provided between the side plates 15. The latching hook 30, which may comprise one or more aligned hook elements, is pivotably mounted on the body 14 in any convenient manner and is pivotable about an axis A, which runs substantially perpendicular to the body 14/plates 15. The hook 30 is pivotable between an open state (shown in FIG. 2) and at least one latching state (shown in FIGS. 1 and 3). In the open state, the latching hook 30 allows the pins 26, 26', 26" to be inserted into or removed from the recess 22. In the latched state, the latching hook 30 prevents the pins 26, 26', 26" from being removed from the recess 22. In alternative embodiments, the latching member may be slidably mounted on the body, or otherwise movable between the open state and the latching state(s), without necessarily being pivotable. Further, the latching member need not necessarily take the form of a hook.

In one embodiment, the ram 32 has its butt end 34 pivotably mounted on the body 14 and the free end 38 of its piston rod 36 is pivotably connected to the latching hook 30, in each case the pivoting movement being about a respective axis that is substantially perpendicular to the plates 15. When the piston rod 36 adopts a retracted state (FIG. 2), the latching hook 30 adopts its open state. When the piston rod 36 is extended, the hook 30 moves towards its latching state. Depending on the location of the pin 26, 26', 26" in the recess 22, the amount by which the piston rod 36 is extended when the hook 30 reaches its latching state can vary. Conveniently, the ram 32 is operable via the excavaor's hydraulic system (not shown), the controls typically being located in the cab of the excavator.

The coupler 10 further includes a second latching member, which may be in the form of a hook 40 which has one end 42 pivotably mounted on the body 14 in any convenient manner, e.g., pin or bearing. The second hook 40 is pivotable about an axis substantially perpendicular to the side plates 15 between a non-latching state (FIG. 2) and a latching state (FIG. 1). In the non-latching state, the hook 40 is clear of the recess 20 to the extent that it does not prevent the pin (not shown) of an attachment from being removed from the recess 20, while in the latching state, the hook 40 prevents the pin from being removed from the recess 20. In the preferred embodiment, the hook 40 includes a jaw 44 which, in the latching state, substantially, or at least partly, closes the otherwise open mouth of the recess 20. The jaw 44 may form part of a recess 46 provided in the hook 40, which recess 46, in the latching state, embraces the pin located in the recess 20. The preferred arrangement is such that the action of an attachment pin (located in recess 20 when the hook 40 is closed) on the jaw 44 urges the hook 40 into its latching state.

An actuator 41, typically in the form of a hydraulic ram or other linear actuator, is coupled to the second latching hook 40 to actuate it between the latching and non-latching states. Other forms of powered actuator could be used (e.g., pneumatic or electrically operated). In the preferred embodiment, the ram 41 has its butt end 43 pivotably mounted on the body 14 and the free end 45 of its piston rod 47 is pivotably connected to the second latching hook 40, in each case the pivoting movement being about a respective axis that is substantially perpendicular to the plates 15. When the piston rod 47 adopts a retracted state (FIG. 2), the latching hook 40 adopts its non-latching state. When the piston rod 47 is extended, the hook 40 adopts its latching state. Conveniently, the ram 41 is operable via the excavator's hydraulic system (not shown), the controls typically being located in the cab of the excavator.

In particular embodiments, the pivot location 42 for the hook 40 is on the opposite side of the recess 20 to the recess 22.

In alternative embodiments, the second latching member need not necessarily take the form of a hook and need not necessarily be pivotable with respect to the body 14. For example, the second latching member may be slidably mounted on the body, or otherwise movable between the non-latching state and the latching state(s), without necessarily being pivotable.

A blocking member, which may be in the form of a bar 50 is pivotable with respect to the body 14 about an axis that is substantially perpendicular with the plates 15. In the illustrated embodiment, the bar 50 has one end 51 pivotably mounted on the body 14, the other end 53 being free. The bar 50 is pivotable with respect to the body between the blocking and non-blocking states under the action of gravity. The bar 50 is movable between a blocking state (shown in FIG. 1) and a non-blocking state (shown in FIGS. 2 and 3). In the blocking state, the bar 50, or at least its free end 53, lies in the path of the second latching hook 40 such that it prevents the second latching hook from moving from its latching state to its non-latching state.

In one embodiment, arrangement is such that should the hook 40 engage with the bar 50 as it attempts to move out of its latching state, the action of the hook 40 on the bar 50 urges the bar 50 into its blocking state. In the illustrated embodiment, the bar 50 is prevented from moving anti-clockwise (as viewed in FIG. 1) from its blocking state, i.e., beyond its blocking state, by any convenient means, e.g., a stop (not shown) provided on the body 14. The position of the bar 50 with respect to the hook 40 is such that the action of the hook 40 on the bar 50 tends to move the bar 50 anti-clockwise (as viewed in FIG. 1), and therefore against the stop. A stop 54, or other suitable means, may be provided for preventing the bar 50 from travelling beyond its non-blocking state (i.e., clockwise from the position shown in FIG. 2).

FIG. 1 shows the coupler 10 in a normal working orientation, which is typically substantially horizontal, or at least relatively horizontal. In FIG. 1, the first latching hook 30 is shown in its latching state holding pin 26 in the recess 22. The second latching hook 40 is also in its latching state holding a pin (not shown) in the recess 20. During normal use, the latching hooks 30, 40 are held in place by their respective rams 32, 41. Should one of the rams 32, 41 fail, the other ram 41, 32 provides a backup to retain at least one of the attachment pins in its recess 20, 22 and so to prevent the attachment from falling from the coupler 10. The bar 50 provides an additional backup safety measure in that it prevents the second latching hook 40 from leaving its latching state. In particular embodiments, the actuators 31, 42 are linked, e.g., hydraulically, such that operation of one actuator causes the operation of the other.

Figure 2:
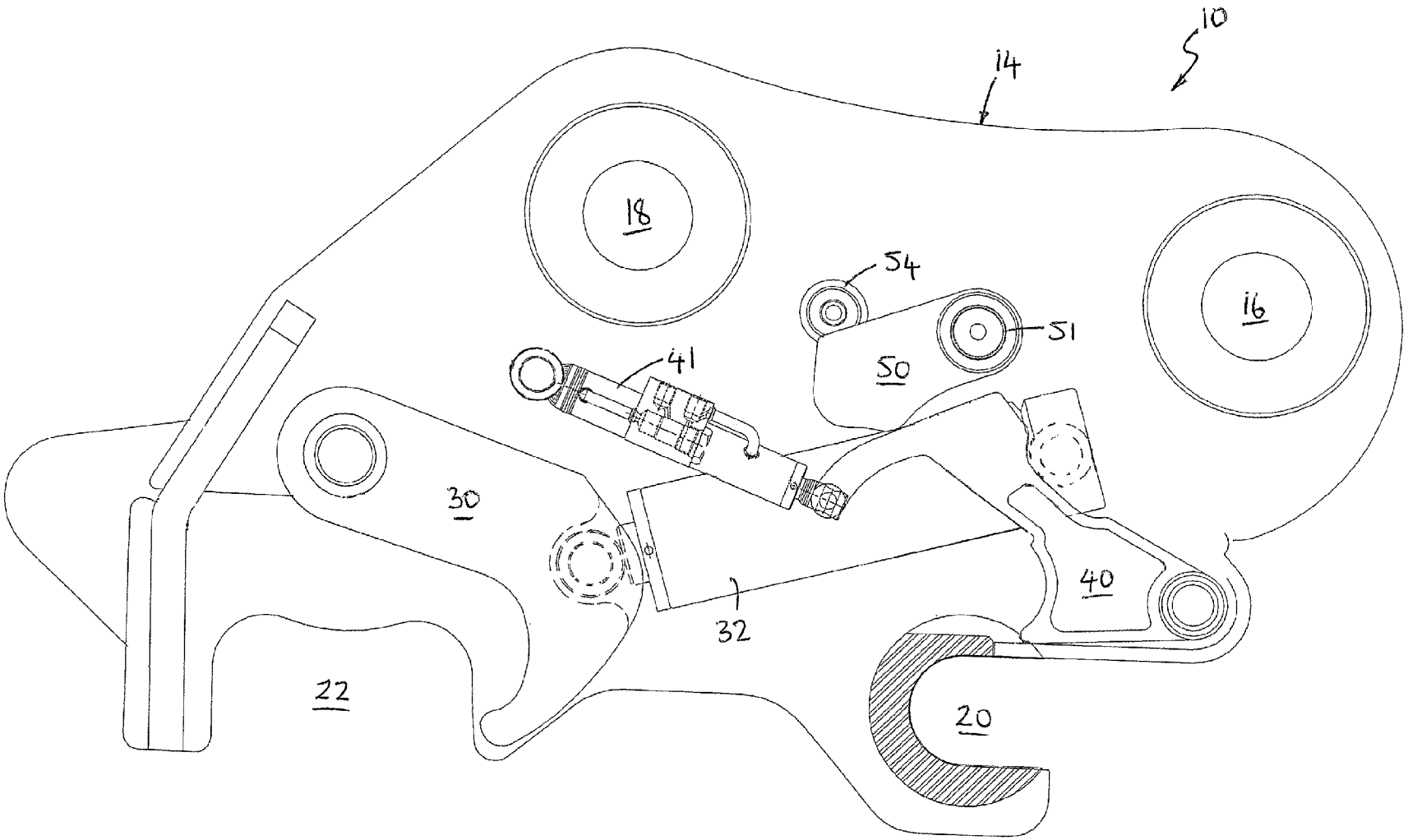
FIG. 2 is a side view of the coupler of FIG. 1 of the drawings, shown in a non-latched state in the use orientation.

FIG. 2 shows the coupler in the orientation of FIG. 1, but with both latching hooks 30, 40 in their non-latching states. In this arrangement, the pins of an attachment can be removed from or placed into the respective recesses 20, 22. It is noted that, in the arrangement of FIG. 2, the second latching hook 40 holds the bar 50 in its non-blocking state.

Figure 3:
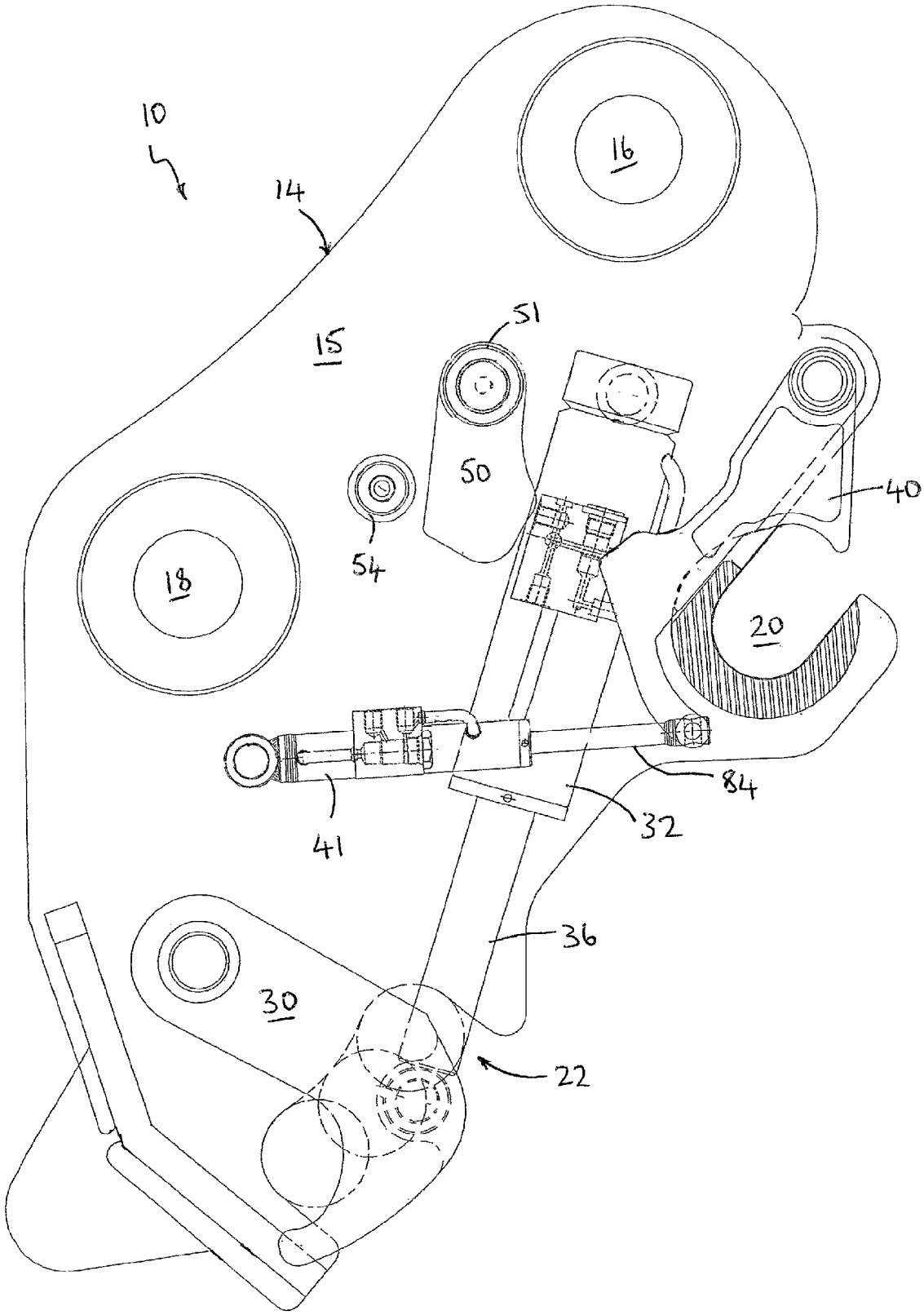
FIG. 3 is a side view of the coupler of FIG. 1 shown in a latched state but in a non-use orientation.
Figure 4:
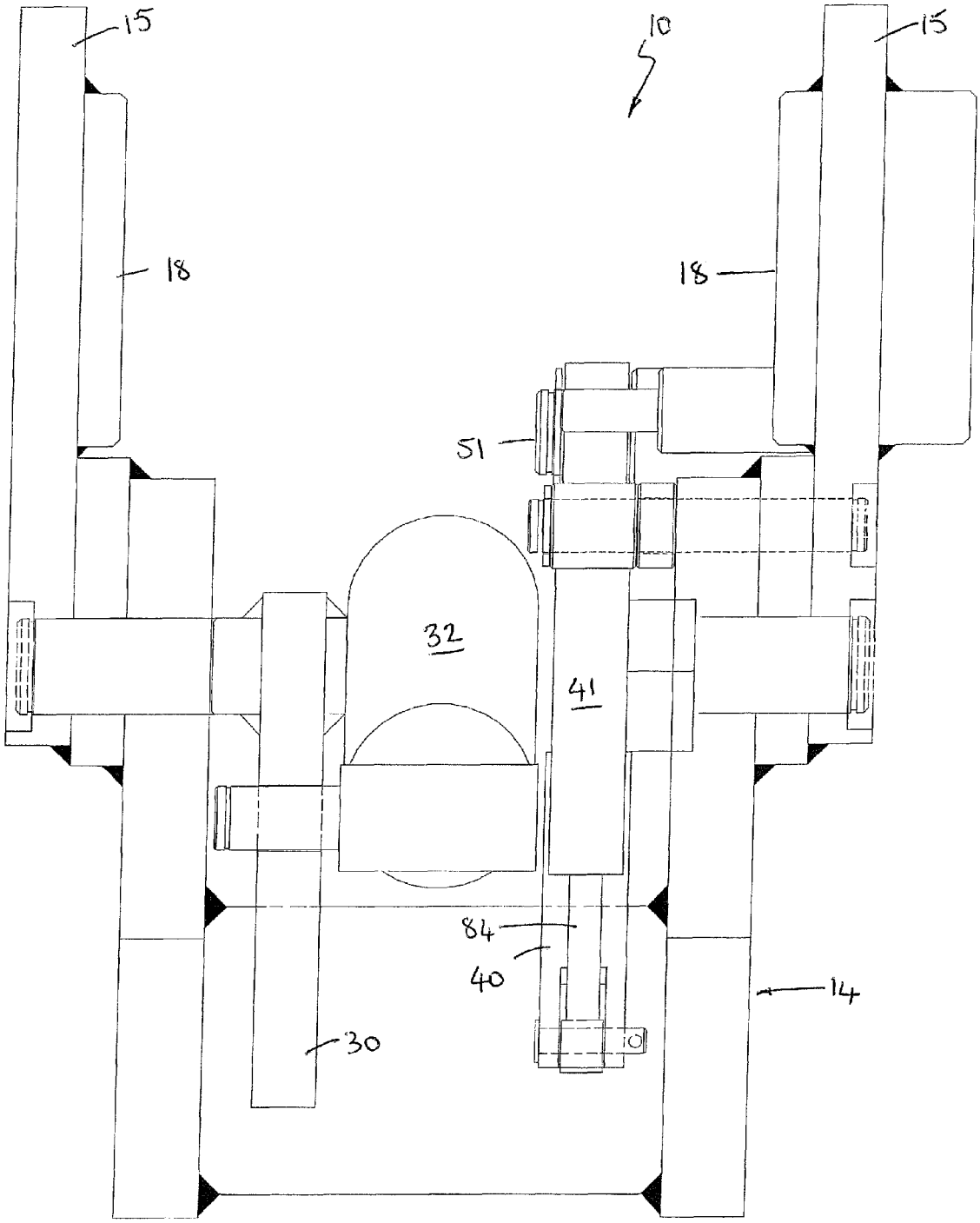
FIG. 4 is an end elevation of the coupler of FIG. 1.

In order to operate the coupler 10 from the state shown in FIG. 1 to the state shown in FIG. 2, the orientation of the coupler 10 has to be changed to cause the bar 50 to adopt the non-blocking state by pivoting relative to the body 14 under the influence of gravity. This is illustrated in FIG. 3, where the coupler 10 is shown in a non-working orientation in which the body 14 has been pivoted with respect to the orientation shown in FIG. 1. This may be effected by the operator from the cab of the excavator by appropriate operation of the mechanism(s) that couple the coupler 10 to the jib arm. As the body 14 is rotated, the bar 50 moves under gravity with respect to the body 14 until it adopts its non-blocking state. In the preferred embodiment, the bar 50 is arranged to hang substantially vertically from its pivot point 51 under the influence of gravity such that it is substantially vertically disposed when in the blocking state. As the coupler 10 is rotated, the bar 50 tends to maintain its substantially vertical orientation.

It is noted that in the orientation of FIG. 3, the open mouth of the recess 20 faces generally upwardly such that any attachment pin located therein will not fall out of the recess 20. Hence, even when the latches 30, 40 are disengaged from the pins, the recess 20 provides means for retaining the attachment on the coupler. This allows the operator to lower the attachment to the ground before pivoting the coupler 10 to release the attachment. In this embodiment, therefore, the arrangement of the bar 50 is such that it adopts the non-blocking state whenever, or at least not before, the open mouth of the recess 20 is facing generally upwards.

When the bar 50 is in the non-blocking state, the latching hook 40 can be withdrawn from its latching state whereupon it serves to hold the bar 50 in its non-blocking state irrespective of subsequent changes in the orientation of the coupler 10. Hence, the coupler 10 can be returned to the working orientation shown in FIG. 2 with both latches 30, 40 open, ready to receive an attachment. Once the attachment pins are located within the respective recesses 20, 22, the rams 32, 41 are operated to close the latching hooks 30, 40 into their latching states, whereupon the bar 50 falls under gravity into its blocking state, i.e., the coupler 10 adopts the arrangement of FIG. 1.

In one embodiment, the arrangement is such that the bar 50 hangs substantially vertically when in the blocking state. A gap may be left between the free end 53 of the bar and the second latching hook 40 when the bar 50 is in its blocking state and the hook 40 is in its latching state (as shown in FIG. 1). These features can be achieved by appropriate selection of the position of the pivot point 51 and the length of the bar 50. For example, the pivot point 51 may be positioned substantially above the recess 20 and, more particularly, substantially above a pin located in the recess 20 during use (when in the orientation shown in FIGS. 1 and 2). Because the pivot point 51 and bar 50 occupy a relatively raised position with respect to the recesses 20, 22, they are less susceptible to becoming jammed during use by, for example, dirt or other foreign matter. Further, the gap between the bar 50 and the hook 40 allows some flexibility in the operation of the coupler 10: should the operator initiate the withdrawal of the hook 40 before pivoting the coupler 10 into the orientation shown in FIG. 3, then provided he initiates the pivoting of the coupler a short time later, the hook 40 will not be blocked by the bar 50.

Figure 5:
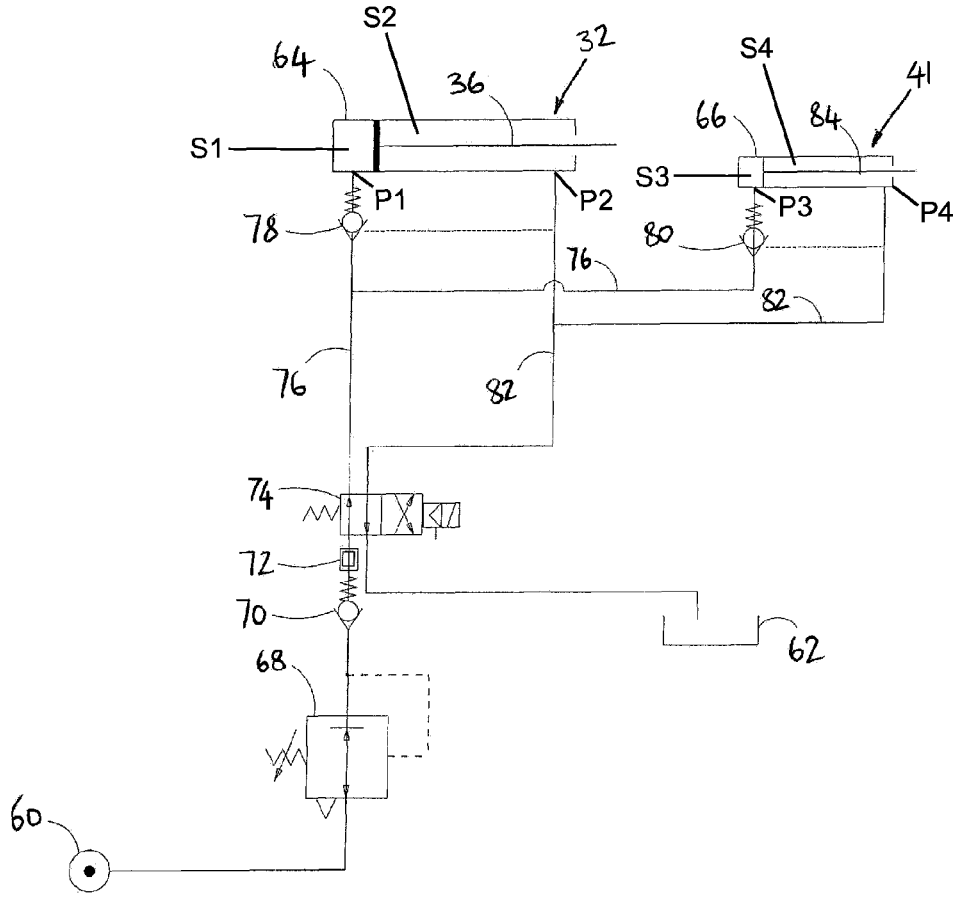
FIG. 5 is a schematic view of a hydraulic circuit for use with the coupler of FIGS. 1 to 4.

Referring now to FIG. 5 of the drawings, operation of the rams 32, 41 is described. FIG. 5 shows a hydraulic circuit for use in controlling the rams 32, 41. The circuit includes a source of hydraulic fluid (typically oil), which typically comprises a hydraulic pump 60, and a sink for the hydraulic fluid in the form of tank 62. The circuit may be controlled by an operator from the cab of the excavator, or other machine, conveniently using a single switch, or other operating device, to control valve 74 as is described in further detail below.

In use, high pressure oil is fed from the pump 60 into a pressure-reducing valve 68. Reduced pressure oil is fed through a non-return valve 70 and restrictor 72 into valve 74.

When valve 74 is in a first mode of operation (corresponding to it being de-energized in this example), reduced pressure oil is fed from valve 74 via extend line 76 through pilot-operated check valve 78 into the extend side S1 of the hydraulic chamber 64 of ram 32 via port P1.

At substantially the same time, reduced pressure oil is fed via extend line 76 through pilot-operated check valve 80 into the extend side S3 of the hydraulic chamber 66 of the ram 41 via port P3.

Low pressure oil from the retract side S2 of the chamber 64 and from the retract side S4 of the chamber 66 returns to tank 62 via P2 and P4, respectively, through the retract line 82 and valve 74. This causes the piston rod 36 of the main ram 32 to extend and causes the piston rod 84 of the secondary ram 41 to extend. This results in both hooks 30, 40 adopting their latching states.

The arrangement may be such that the secondary ram 41 works first because frictional resistance is lower (smaller piston less friction) than for the main ram. Also, a smaller volume of oil is required to move the piston of the secondary ram 41 so it will travel faster. Oil volume to the cylinders may be reduced through the use of the restrictor fitted prior to the valve. When the secondary ram 41 moves, the actuating pressure seen by both rams 32, 41 drops until the volume of oil is replaced. This then causes the secondary ram 41 to move again. Hence, the main ram 32 does not move until the secondary ram 41 stops moving, i.e., fully in or fully out.

When valve 74 is in a second mode of operation (corresponding to it being energized in this example), reduced pressure oil is fed from valve 74 via retract line 82 into the retract side S2 of the chamber 62 of the main ram 32 via port P2. The oil is also fed into the pilot of the check valve 78 thereby opening the check valve 78 and allowing oil to flow through the check valve 78 out of the extend side S1 of the chamber 62 via port P1.

At substantially the same time, reduced pressure oil is fed via retract line 82 into the retract side S4 of the chamber 66 of the secondary ram 41 via port P4. The oil is also fed into the pilot of the check valve 80 thereby opening the check valve and allowing oil to flow through the check valve 80 out of the extend side S3 of the chamber 66 via port P3.

Low pressure oil from the extend side S1 of the main ram 32 and from the retract side S3 of the secondary ram 41 returns to tank 62 via P1 and P3, respectively, through the extend line 76 and valve 74. This causes the piston rod 36 of the main 32 to retract and the piston rod 82 of the secondary ram 41 to retract.

The arrangement may be such that the secondary ram 41 works first because frictional resistance is lower (smaller piston less friction) than for the main ram. Also, a smaller volume of oil is required to move the piston of the secondary ram 41 so it will travel faster. Oil volume to the cylinders may be reduced through the use of the restrictor fitted prior to the valve. When the secondary ram 41 moves, the actuating pressure seen by both rams 32, 41 drops until the volume of oil is replaced. This then causes the secondary ram 41 to move again. Hence, the main ram 32 does not move until the secondary ram 41 stops moving, i.e., fully in or fully out.

The following advantageous features of the operation of the rams 32, 41 using the hydraulic circuit illustrated in FIG. 5 are noted: the use of a pressure reduction valve 68 on the inlet of valve 74—this extends hose life due to the lowered working pressure within the hoses; the use of a non-return valve 70 on the inlet of valve 74 which prevents oil pressure in the system being lost when the pump 60 output pressure is low, e.g., at low engine speeds; the use of a restrictor 72 on the inlet of valve 74 which reduces hose vibration when operating; the use of a pilot-operated check valve 78 on the inlet of ram 32 which effectively locks the ram 32 in the extended state in the event of hose or hydraulic pressure failure; the use of a pilot-operated check valve 80 on the inlet of ram 41 which effectively locks the ram 41 in the extended state in the event of hose or hydraulic pressure failure; and the connection of 41 such that it must retract to remove the secondary hook 40, and works in tandem with the main ram 32—this prevents application of equal pressures of oil to both the retract and extend lines 76, 82 causing a change of state to the extended secondary ram.

The primary ram 32 is connected to the first latching hook 30 and the secondary ram 41 is used to work the secondary hook 40. The secondary ram 41 must retract in order to remove the secondary hook 40 to allow the main hook 30 to retract.

Figure 6:
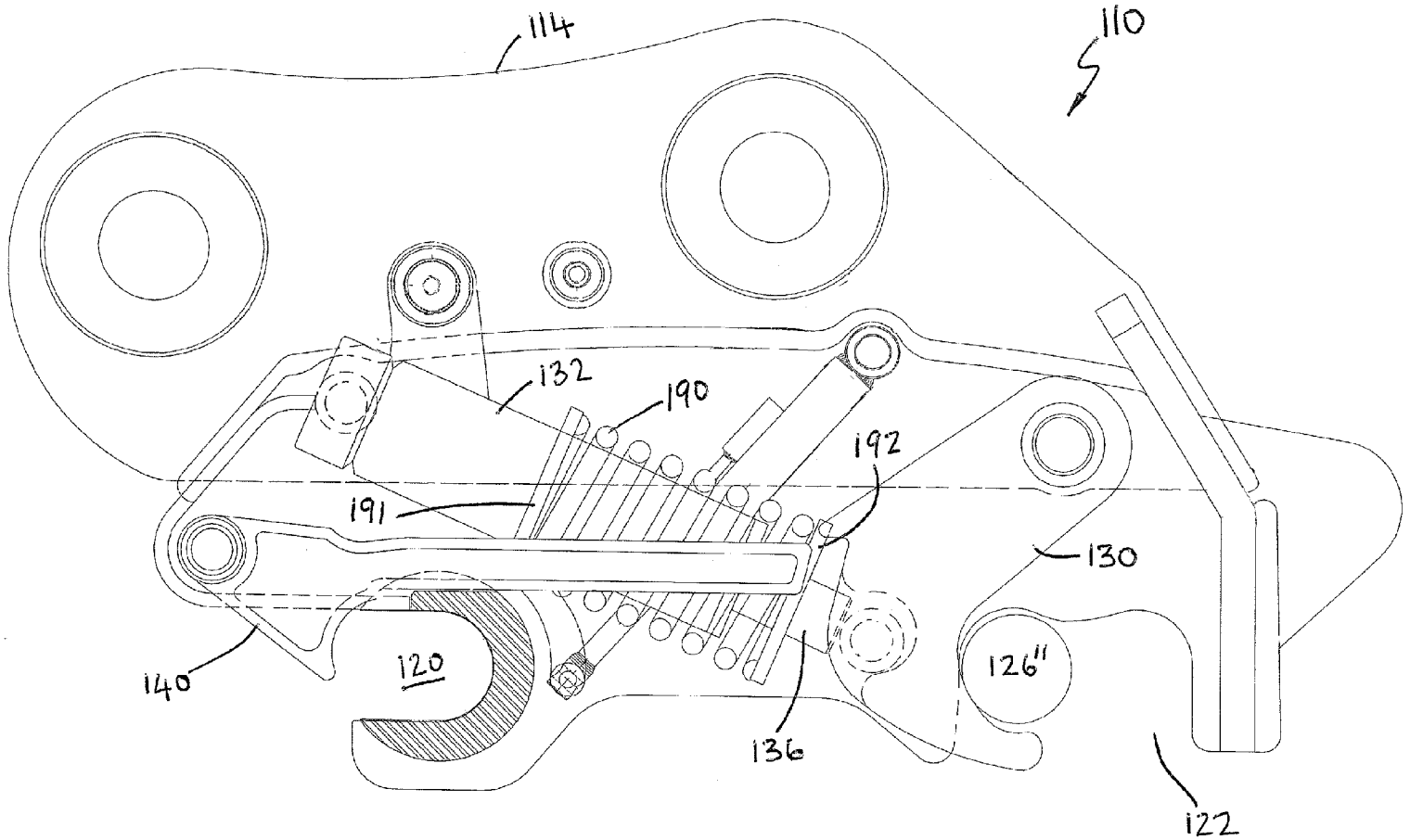
FIG. 6 is a side elevation of an alternative embodiment of a coupler embodying the invention.
Figure 7:
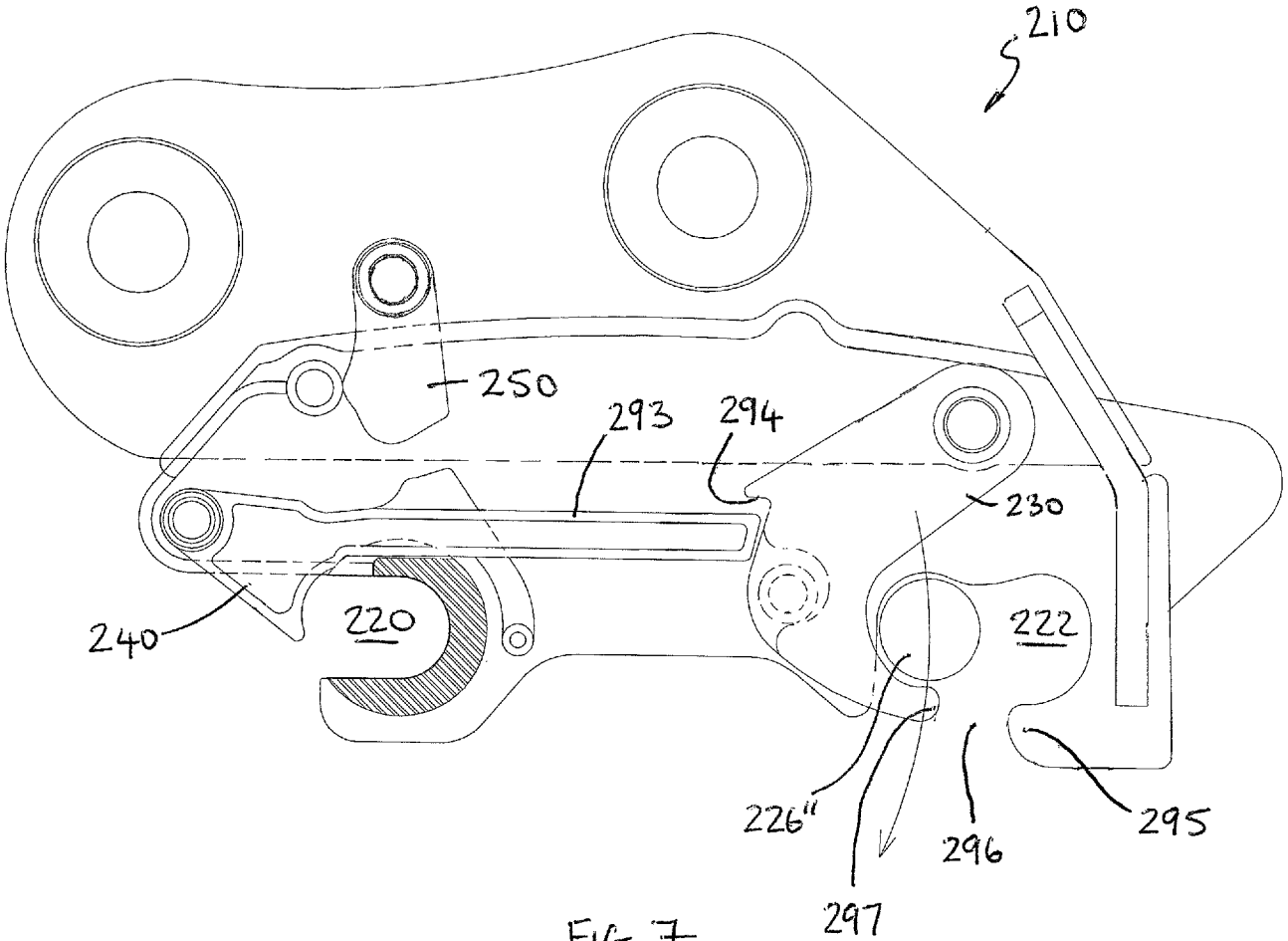
FIG. 7 is a side elevation of a further alternative embodiment of a coupler embodying the invention.
Figure 8:
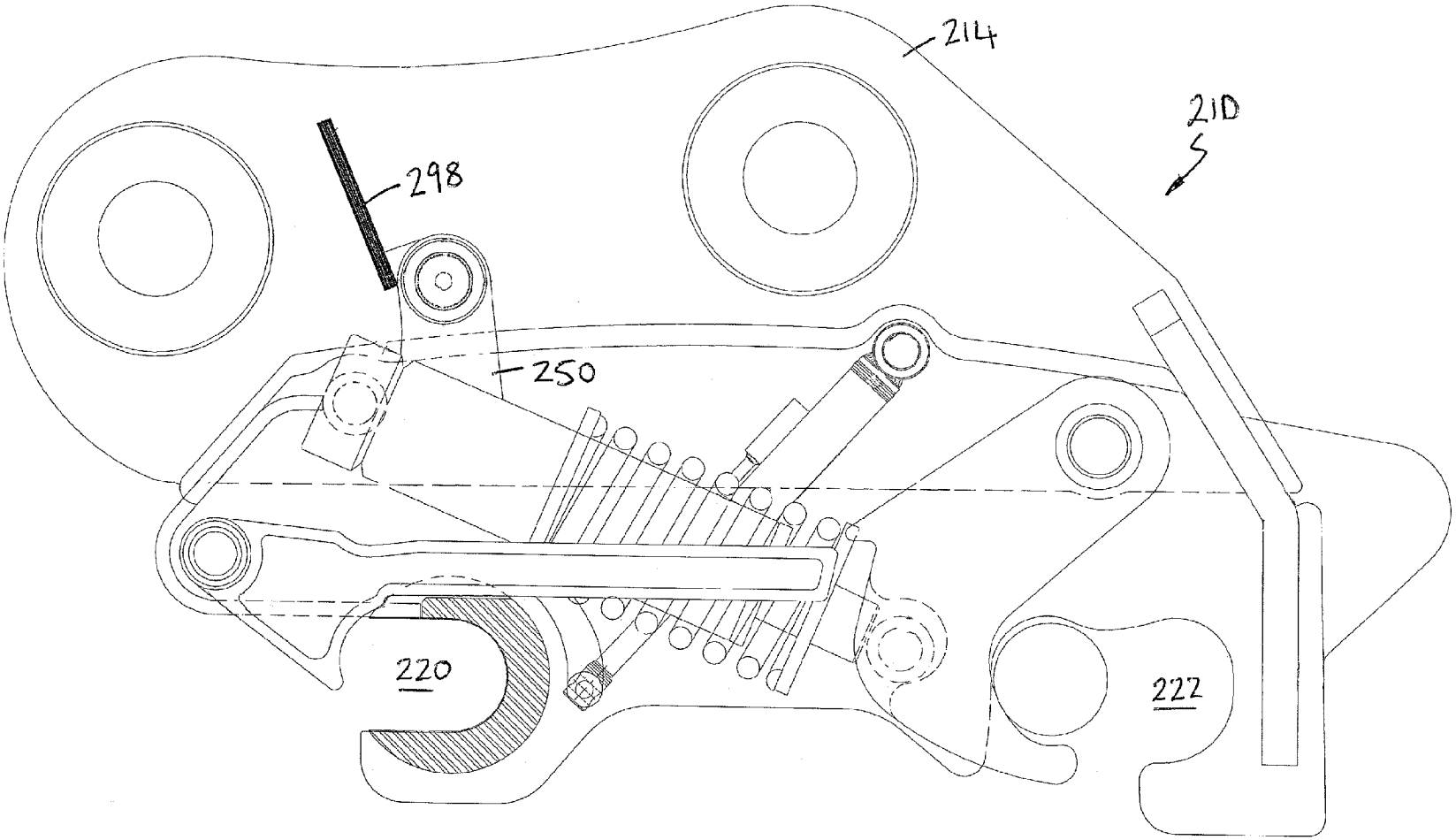
FIG. 8 is an alternative side elevation of the coupler of FIG. 7.

Referring now to FIGS. 6 to 9, there is described alternative embodiments of the invention and variations thereof. The couplers shown in FIGS. 6 to 8 are similar to the couplers shown in FIGS. 1 to 4 and the same description applies as would be apparent to a skilled person. Like numerals are used to indicate like parts.

FIG. 6 shows a coupler 110 wherein resilient biasing means, conveniently in the form of a spring 190, is provided on an actuator 132 and arranged to resiliently bias the actuator 132, and in particular a rod 136, into its extended position. In FIG. 6 the spring 190 takes the form of a compression spring. The spring 190 is shown in FIG. 6 externally of the actuator 132, for example, extending between a first abutment 191 provided on the piston housing and a second abutment 192 provided on the rod 136. Alternatively, the spring, or other resilient biasing means, may be fitted internally of the piston housing. The biasing means may be a mechanical spring as illustrated but may take any suitable alternative form, e.g., a gas spring, or the like. The purpose of the spring 190 is to hold the actuator 132 in its extended state and so to hold the latching hook 130 in a forward or latching state in the event of the loss of actuating force from the actuator 132 due, for example, to a hydraulic or mechanical failure of the actuator 132 or its supply.

FIG. 7 shows a coupler 210 embodying the invention wherein a locking member 293 is associated with a second latching hook 240, the locking member 293 extending in a direction towards a first latching hook 230 and being shaped and dimensioned to engage with the first latching hook 230. In one embodiment, the arrangement is such that, when the first latching hook 230 is in its latching state (as shown in FIG. 7), a clearance is provided between the latching hook 230 and the locking member 293 in order to allow the second latching hook 240 to move out of its latching state, but that a retraction of the first latching hook 230 from the latching state causes the first latching hook 230 to engage with the locking member 293. It is noted that, in the illustrated embodiment, the amount of retraction of the first latching hook 230 before engagement occurs is sufficiently small that the first latching hook 230 still holds the relevant attachment pin 226" in place, even though the actuator 232 may no longer be urging the hook 230 into engagement with the pin 226", i.e., the hook 230 is not retracted to the extent that it adopts its non-latching state and may, therefore, be said to maintain the hook 230 in a latching state. In cases where the first latching hook 230 has more than one latching state (to accommodate attachments with different pin spacings), the locking member 293 is preferably arranged to engage with the latching hook 230 as it is retracted from the latching state that corresponds with the smallest pin spacing (as illustrated in FIG. 7).

The locking member 293, which is shown by way of example in the form of an arm, may be integrally formed with the second latching hook 240, or fixed or coupled thereto. One arrangement is that the locking member 293 moves with the second latching hook 240. The first latching hook 230 may include a seat 294 for engaging with the locking member 293, the seat being arranged such that, when the locking member 293 is engaged therewith, the action of the first latching hook 230 on the locking member 293 serves to hold the second latching hook 240 in its latching state. In FIG. 7, the seat 294 takes the form of a recess formed in the rear of the latching hook 230, but it may, alternatively, take other forms.

In use of the illustrated embodiment, the free end of the locking member 293 mates with the recess 294 when the first latching hook 230 is retracted and the second latching hook 240 is in its latching state. This engagement prevents any subsequent movement of the second latching hook 240 out of the latching state. The purpose of this is to retain the second latching hook 240 in the latching state thereby preventing separation of the attachment from the coupler. This could occur, for example, if the main latching hook 230 of the coupler is unlocked when the coupler is in an incorrect attitude causing the movement of the second hook 240 to be prevented by the gravity safety device 250.

In particular embodiments, the profile of the bottom of the coupler 210 is extended at the rear of the rear pin receiving recess 222 in the side plate of the coupler in a direction towards the front of the coupler to provide a lip 295. The purpose of the extended profile, or lip 295, is so that a gap 296 is formed between the toe 297 of the first hook 230 (when the first hook 230 is in the position where it would just contact the rear pin of an attachment, with the attachment pin centres being at the minimum range for coupler) and the edge of the extended profile 295 is less than the diameter of the attachment pin 226". As a result, the rear pin 226" of the attachment will not pass through the gap 296. In order to facilitate the coupling of attachments with centres at the top end of the range of pin centres catered for by the coupler a curved surface, preferably with a relatively large radius, is preferred on the underside of the lip 295 to guide the rear pin into the receiving recess 222.

Figure 9:
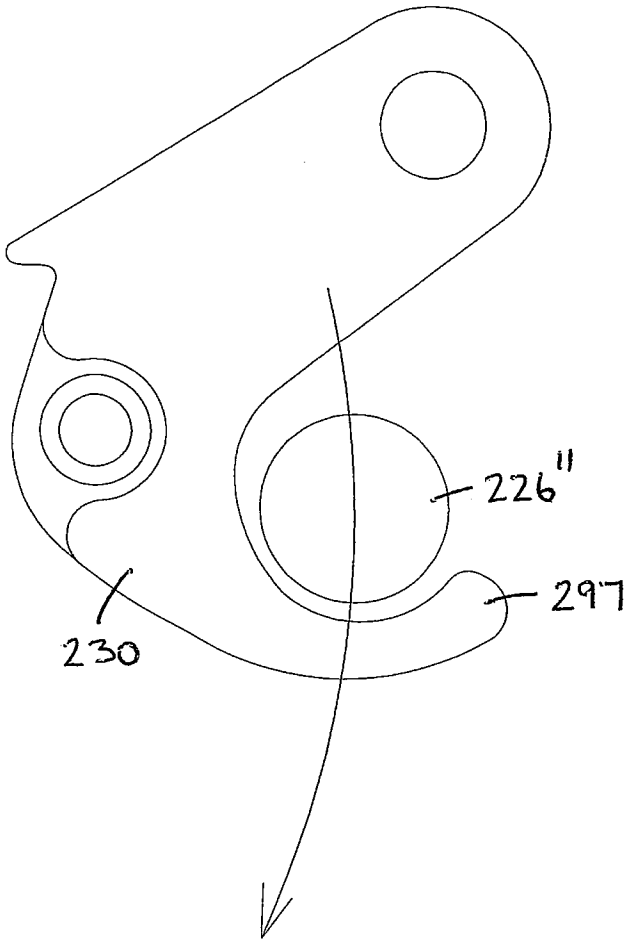
FIG. 9 is a side view of a latching hook, suitable for use with couplers embodying the present invention.

As may best be seen from FIG. 9, the toe 297 of the first latch 230 may be shaped and dimensioned such that the pin 226" may be retained within the first latch 230 profile by its own weight as is characteristic with a load-bearing hook for supporting a load. To this end, the hook shape of the latch 230 may be such that the weight of the pin urges the hook 230 about its pivot point towards its latched state. In particular embodiments, the action of the spring 190, advantageously together with the action of the bottom profiles, in conjunction with the shape of the hook 230 retain the rear pin within the rear recess of the coupler through the effort of the spring alone.

Referring now to FIG. 8, the coupler 210 is shown with a resiliently deformable member 298 provided on the blocking member 250. The deformable member 298 is shown as being straight, although it may be curved, or a combination of straight and curved (for example, straight with a curved or bent free end). The deformable member 298 may, for example, take the form of a leaf spring. The member 298 is arranged to engage with an arm (not shown) of an excavator or other machine to which the coupler is mounted during use in certain orientations. It may be arranged to engage with the dipper arm (or other part) of the excavator when the coupler is in the full curl or dump position. The arrangement is such that the action of the resiliently deformable member 298 when engaged with the arm will bias the gravity blocking device 250 into its blocking state, thereby preventing movement of the second latch 240 into its unlatched state.

It will be understood that all of the features of all of the embodiments described herein may be used in combination with any features of the other embodiments described herein as would be understood by a skilled person.

The invention is not limited to the embodiments described herein which may be modified or varied without departing from the scope of the invention.

The embodiments of the invention in which an exclusive property or privilege is claimed are defined as follows:

1. A coupler for an excavator, the coupler comprising:

a main body having first and second spaced-apart recesses for receiving respective pins of an excavator attachment;

a first latching member comprising a first body, said first latching member being pivotably coupled to said main body and being movable into and out of a latching state in which it is capable of retaining a respective attachment pin in said first recess;

a second latching member comprising a second body, said second latching member being pivotably coupled to said main body and being movable into and out of a latching state in which it is capable of retaining a respective attachment pin in said second recess;

at least one actuator coupled to said main body and configured to selectively actuate said first latching member into and out of said latching state and actuate said second latching member into and out of said latching state; and a blocking member comprising a body having a free end, said blocking member being movable into and out of a blocking state in which said blocking member lies in the path of the second latching member to prevent the second latching member from leaving its latching state by engagement with said free end, said blocking member being movable into and out of said blocking state under the influence of gravity, wherein said blocking member is pivotably coupled to the body at a pivot point having a pivot axis that is fixed with respect to said body, and wherein said coupler is operable in a first mode of use in which said second latching member is in said latching state, said blocking member is in said blocking state and hangs substantially vertically from said pivot point under the influence of gravity, and wherein said pivot point is positioned and said blocking member is dimensioned to define a gap between said free end of said blocking member and said second latching member and such that said blocking member is located above and does not engage with said second latching member in said first mode of operation, and wherein said second latching member is pivotably coupled to said coupler at a pivot point that is located beyond said second recess with respect to said first recess and spaced apart from the mouth of said second recess in a direction substantially parallel with a notional axis joining said first and second recesses.

2. A coupler as claimed in claim 1, wherein the blocking member is movable into and out of its blocking state upon movement of the coupler between a working orientation and a non-working orientation.

3. A coupler as claimed in claim 1, further including a first stop member located in a path of movement of said blocking member, movement of said blocking member in a first direction being limited by engagement with said first stop member, and wherein said blocking member adopts said blocking state when engaged with said first stop member.

4. A coupler as claimed in claim 1, further including a second stop member located in a path of movement of said blocking member, movement of said blocking member in a second direction being limited by engagement with said second stop member, and wherein said blocking member adopts a non-blocking state when engaged with said second stop member.

5. A coupler as claimed in claim 1, wherein said pivot point of said blocking member is positioned with respect to the second latching member such that engagement of said second latching member with said free end of said blocking member upon movement of said second latching member out of its latching state urges said blocking member into its blocking state.

6. A coupler as claimed in claim 5 further including a first stop member located in a path of movement of said blocking member, movement of said blocking member in a first direction being limited by engagement with said first stop member, and wherein said blocking member adopts said non-blocking state when engaged with said first stop member and wherein engagement of said second latching member with said blocking member upon movement of said second latching member out of its latching state urges said blocking member into engagement with said first stop member.

7. A coupler as claimed in claim 1, wherein said second latching member takes the form of a hook including a jaw portion that at least partially closes the mouth of said second recess when in the latching state.

8. A coupler as claimed in claim 1, wherein said at least one actuator includes a first actuator coupled to said first latching member and is provided with a resilient biasing member arranged to urge said first actuator coupled to said first latching member into a state corresponding to said latching state of said first latching member.

9. A coupler as claimed in claim 8, wherein said first actuator comprises a linear actuator, said biasing member being arranged to urge said linear actuator into an extended state.

10. A coupler as claimed in claim 1, wherein said second latching member includes a portion that, when the second latching member is in its latching state, is located in a path of movement of said first latching member such that said portion of said second latching member is engagable with said first latching member when said first latching member is moved towards its non-latching state, wherein upon engagement of said portion of said second latching member with said first latching member, said first latching member holds said second latching member in said latching state by preventing movement of said second latching member out of said latching state.

11. A coupler as claimed in claim 10, wherein said first latching member includes a seat for engagement with said portion of said second latching member, said seat being shaped such that the action of said first latching member on said portion of said second latching member urges said second latching member into its latching state.

12. A coupler as claimed in claim 10, wherein said seat is shaped such that engagement of said first latching member with said portion of said second latching member serves to hold said first latching member in its latching state.

13. A coupler as claimed in claim 1, wherein said first recess is shaped and dimensioned to receive attachment pins in different locations corresponding to different attachment pin spacings, said first recess further including a lip at one side of a mouth, and wherein when said first latching member adopts a latching position corresponding to the smallest attachment pin spacing accommodated by the coupler, a gap being defined between the first latching member and said lip, and wherein the arrangement is such that said gap has a size that is less than the width of the respective attachment pin.

14. A coupler as claimed in claim 13, wherein said lip extends from the side of the first recess that is furthest from the second recess and in a direction substantially towards said second recess.

15. A coupler as claimed in claim 1, wherein a resiliently deformable member is coupled to the blocking member and is arranged to engage with an arm of the excavator such that the action of the resiliently deformable member when engaged with the arm biases the blocking member into its blocking state.

16. A coupler as claimed in claim 1, wherein said at least one actuator comprises a first hydraulic ram coupled to said first latching member and a second hydraulic ram coupled to said second latching member, said hydraulic rams being hydraulically inter-linked such that the operation of one of said first and second hydraulic rams between the latching and non-latching states causes operation of the other of said first and second hydraulic rams between the latching and non-latching states.

17. A coupler as claimed in claim 16, wherein said first and second hydraulic rams are controlled by a common hydraulic circuit, each of said hydraulic rams sharing a common hydraulic fluid feed line and a common hydraulic fluid return line.

18. A coupler as claimed in claim 17, wherein at least one of said first and second hydraulic rams have a pilot non-return valve at a respective extend side port, the pilot control line being connected to the respective retract side port.

19. A coupler as claimed in claim 1, wherein said coupler is operable in a second mode of use in which said second latching member is in said latching state and said blocking member is out of said blocking state, said coupler being operable between said first and second modes of operation by rotation of said coupler about said pivot axis.

20. A coupler as claimed in claim 19, wherein said pivot point is positioned and said blocking member is dimensioned so that, in said second mode of use, upon movement of said second latching member out of said latching state, said second latching member engages with said blocking member to hold said blocking member out of said blocking state.

21. A coupler as claimed in claim 1, wherein said at least one actuator comprises a first actuator and a second actuator, said first actuator being coupled to said main body and to said first latching member and configured to selectively actuate said first latching member into and out of said latching state, and said second actuator being coupled to said main body and to said second latching member and configured to selectively actuate said second latching member into and out of said latching state.

22. A coupler for an excavator, the coupler comprising:

a main body having first and second spaced-apart recesses for receiving respective pins of an excavator attachment;

a first latching member comprising a first body, said first latching member being pivotably coupled to said main body and being movable into and out of a latching state in which it is capable of retaining a respective attachment pin in said first recess;

a second latching member comprising a second body, said second latching member being pivotably coupled to said main body and being movable into and out of a latching state in which it is capable of retaining a respective attachment pin in said second recess;

at least one actuator coupled to said main body and configured to selectively actuate said first latching member into and out of said latching state and actuate said second latching member into and out of said latching state; and a blocking member comprising a body having a free end, said blocking member being movable into and out of a blocking state in which said blocking member lies in the path of the second latching member to prevent the second latching member from leaving its latching state by engagement with said free end, said blocking member being movable into and out of said blocking state under the influence of gravity, wherein said blocking member is pivotably coupled to the body at a pivot point having a pivot axis that is fixed with respect to said body, and wherein said coupler is operable in a first mode of use in which said second latching member is in said latching state, said blocking member is in said blocking state and hangs substantially vertically from said pivot point under the influence of gravity, and wherein said pivot point is positioned and said blocking member is dimensioned to define a gap between said free end of said blocking member and said second latching member and such that said blocking member is located above and does not engage with said second latching member in said first mode of operation, and wherein said second latching member includes a portion that, when the second latching member is in its latching state, is located in a path of movement of said first latching member such that said portion of said second latching member is engagable with said first latching member when said first latching member is moved towards its non-latching state, wherein upon engagement of said portion of said second latching member with said first latching member, said first latching member holds said second latching member in said latching state by preventing movement of said second latching member out of said latching state.

23. The coupler of claim 22, wherein said at least one actuator comprises a first actuator and a second actuator, said first actuator being coupled to said main body and to said first latching member and configured to selectively actuate said first latching member into and out of said latching state, and said second actuator being coupled to said main body and to said second latching member and configured to selectively actuate said second latching member into and out of said latching state.

24. A coupler for an excavator, the coupler comprising:

a main body having first and second spaced-apart recesses for receiving respective pins of an excavator attachment;

a first latching member comprising a first body, said first latching member being pivotably coupled to said main body and being movable into and out of a latching state in which it is capable of retaining a respective attachment pin in said first recess;

a second latching member comprising a second body, said second latching member being pivotably coupled to said main body and being movable into and out of a latching state in which it is capable of retaining a respective attachment pin in said second recess;

at least one actuator coupled to said main body and configured to selectively actuate said first latching member into and out of said latching state and actuate said second latching member into and out of said latching state; and a blocking member comprising a body having a free end, said blocking member being movable into and out of a blocking state in which said blocking member lies in the path of the second latching member to prevent the second latching member from leaving its latching state by engagement with said free end, said blocking member being movable into and out of said blocking state under the influence of gravity, wherein said blocking member is pivotably coupled to the body at a pivot point having a pivot axis that is fixed with respect to said body, and wherein said coupler is operable in a first mode of use in which said second latching member is in said latching state, said blocking member is in said blocking state and hangs substantially vertically from said pivot point under the influence of gravity, and wherein said pivot point is positioned and said blocking member is dimensioned to define a gap between said free end of said blocking member and said second latching member and such that said blocking member is located above and does not engage with said second latching member in said first mode of operation, and wherein a resiliently deformable member is coupled to the blocking member and is arranged to engage with an arm of the excavator such that the action of the resiliently deformable member when engaged with the arm biases the blocking member into its blocking state.

25. The coupler of claim 24, wherein said at least one actuator comprises a first actuator and a second actuator, said first actuator being coupled to said main body and to said first latching member and configured to selectively actuate said first latching member into and out of said latching state, and said second actuator being coupled to said main body and to said second latching member and configured to selectively actuate said second latching member into and out of said latching state.

* * * * *